US005310361A

United States Patent [19]

Muchowicz et al.

[11] Patent Number: 5,310,361

[45] Date of Patent: May 10, 1994

[54] HIGH-VOLTAGE X-RAY CABLE CONNECTION

[75] Inventors: Thomas J. Muchowicz, Elk Grove Village; Arkady Kantor, Buffalo Grove, both of Ill.

[73] Assignee: Eureka X-Ray Tube Corp., Arlington Hts., Ill.

[21] Appl. No.: 984,291

[22] Filed: Nov. 30, 1992

[51] Int. Cl.[5] ..... H01R 13/648

[52] U.S. Cl. ..... 439/610; 439/320; 174/75 D; 378/202

[58] Field of Search ..... 174/75 D; 439/447, 320, 439/610, 98, 448; 378/202

[56] References Cited

U.S. PATENT DOCUMENTS

| | | | |
|---|---|---|---|
| 2,273,538 | 2/1942 | Rogers | 174/75 D |
| 2,280,711 | 4/1942 | Machlett et al. | 174/75 D |
| 3,178,503 | 4/1965 | Bell et al. | 174/75 D |
| 3,316,524 | 4/1967 | Pastor | 439/320 |
| 3,982,059 | 9/1976 | Holland et al. | 174/73 R |
| 4,335,928 | 6/1982 | Barrett et al. | 439/519 |
| 4,577,339 | 3/1986 | Klostermann | 378/121 |

OTHER PUBLICATIONS

"High Voltage X-ray Cables and Receptacles", NEMA Standards Publication No. XR-7 ©1988.

*Primary Examiner*—Gary F. Paumen

*Attorney, Agent, or Firm*—Godfrey & Kahn

[57] ABSTRACT

A high-voltage cable connection (10) includes a standard terminal (12) which fits into a female receptacle in a power supply or x-ray tube to make an electrical connection. A cable (14) is routed through a proximal end (30) of the terminal (12). A clamp (18) secures a jacket (42) of the cable (14) to a cap (16) at the prominal end (30). A boot (20) envelops the cable (14) at a point where the cable (14) enters the terminal (12). A collar (22) which is split into halves or segments (22A, 22B) fits conformably about a boundary formed between the proximal end (30) of the terminal (12) and the boot (20). A ring (24) fits about the collar (22) to hold the segments (22A, 22B) together. A nut (26) having an external thread portion fits over the collar (22) and the ring (24), the nut (26) being rotatable about the collar (22) and the ring (24) and mating with internal threads which form a part of the female receptacle in the power supply or the x-ray tube.

17 Claims, 3 Drawing Sheets

HIGH-VOLTAGE X-RAY CABLE CONNECTION

FIELD OF THE INVENTION

The present invention relates generally to a high-voltage x-ray cable connection for use in connecting equipment such as an x-ray tube with a power source.

BACKGROUND OF THE INVENTION

In the use of equipment which employs x-ray tubes or other devices which require high voltages (on the range of 75 kilovolts), cable connections to such devices include a female insulating receptacle on the x-ray tube or high-voltage power source, and an insulating male sleeve which terminates the end of the high-voltage cable. The male sleeve is inserted into the female receptacle to make the electric connection, and the female receptacle and male sleeve are basically conventional components of high-voltage connectors. A fluid or viscus dielectric medium may be used in the small clearance space between the receptacle and sleeve to displace air which would otherwise provide a path for high voltage arcing and breakdown.

The high-voltage cable may extend one hundred feet or more between the high-voltage power source and the x-ray tube or other device, and the x-ray cable needs to be flexible for routing of the cable and to enable the operator to move the equipment to which the cable is connected without excessive effort. In facilitating the routing and movement of the cable, it is desireable that the junction between the cable and the male sleeve accommodates a wide range of cable movement. High-voltage cables of the prior art, therefore, incorporate a U-joint, pivot, or similar means which enables the operator to readily move or manipulate the cable. These means of joining the cable and male sleeve are not without their limitations, however.

Accordingly, a need has arisen for a high-voltage cable connection which is flexible at the junction between the male sleeve and the cable to accommodate a wide range of movement, and which is easily assembled, disassembled and repaired.

SUMMARY OF THE INVENTION

In accordance with the present invention a high-voltage x-ray cable connection comprises a standard terminal which includes a male sleeve having a proximal end and a distal end, and which fits into a female receptacle in a power supply, x-ray tube, or the like to make the electrical connection. A cap covers the proximal end of the male sleeve and includes a base and a flared conduit which extends outward from the base. A cable is routed through the conduit and into the male sleeve, and further includes a jacket which extends over an outside boundary of the conduit, while the remainder of the cable extends through the inside boundary of the conduit. A clamp then secures the jacket of the cable against the outside boundary of the conduit.

A flexible boot envelops the circumference of the cable at the proximal end of the sleeve. A collar which is split into two halves fits conformably about a boundary formed between the proximal end of the sleeve and the flexible boot to position the boot against the proximal end of the male sleeve, and a ring is used which fits about the collar to hold the halves or segments of the collar together. A nut having an external thread portion fits over the collar and the ring, the external thread portion mating with internal threads which form a part of the female receptacle of the x-ray tube or the power supply.

The high-voltage x-ray cable connection of the present invention is flexible at the junction between the cable and the terminal to facilitate manipulation of the cable by a user. The cable is easily assembled, disassembled, and repaired.

Further objects, features, and advantages of the invention will be apparent from the following detailed description taken in conjunction with the accompanying drawings.

DETAILED DESCRIPTION OF THE PREFERRED EMBODIMENT

Figure 1:
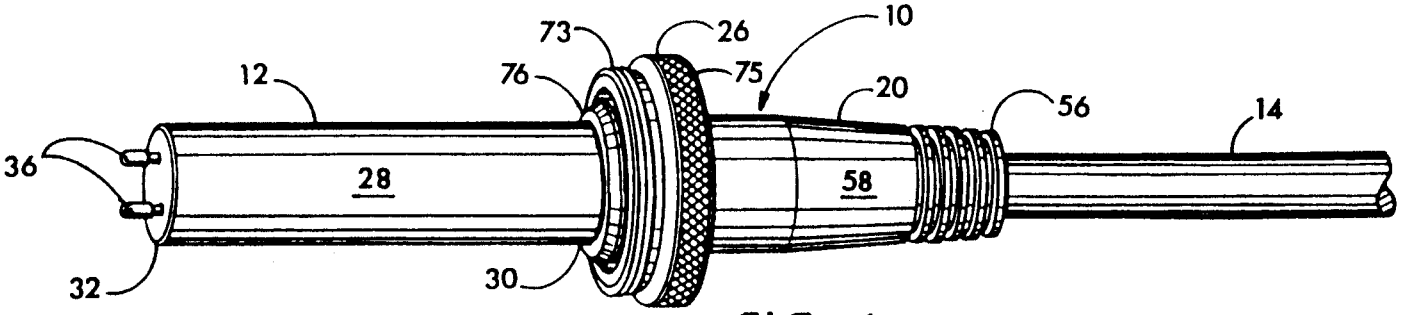
FIG. 1 is a perspective view of the high-voltage x-ray cable connection of the present invention.
Figure 2:
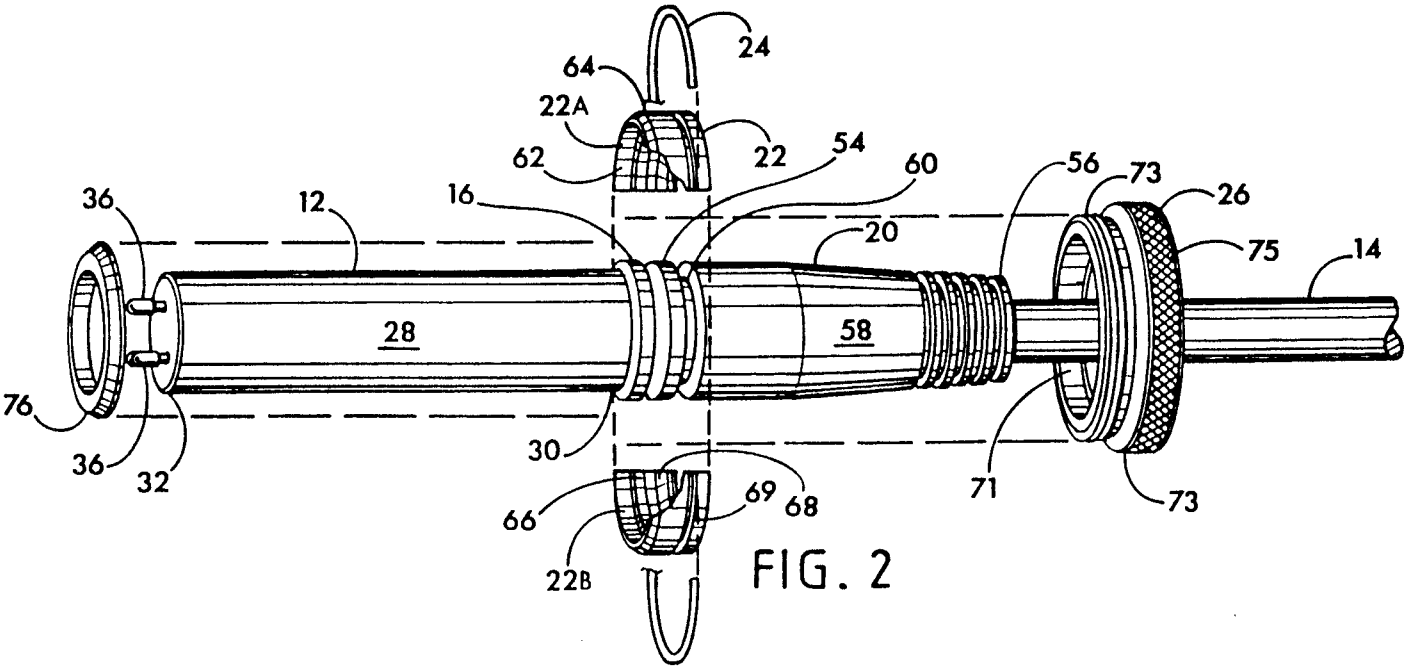
FIG. 2 is an exploded perspective view of the high-voltage x-ray cable connection of the present invention, showing certain of the parts in disassembled relationship.
Figure 3:
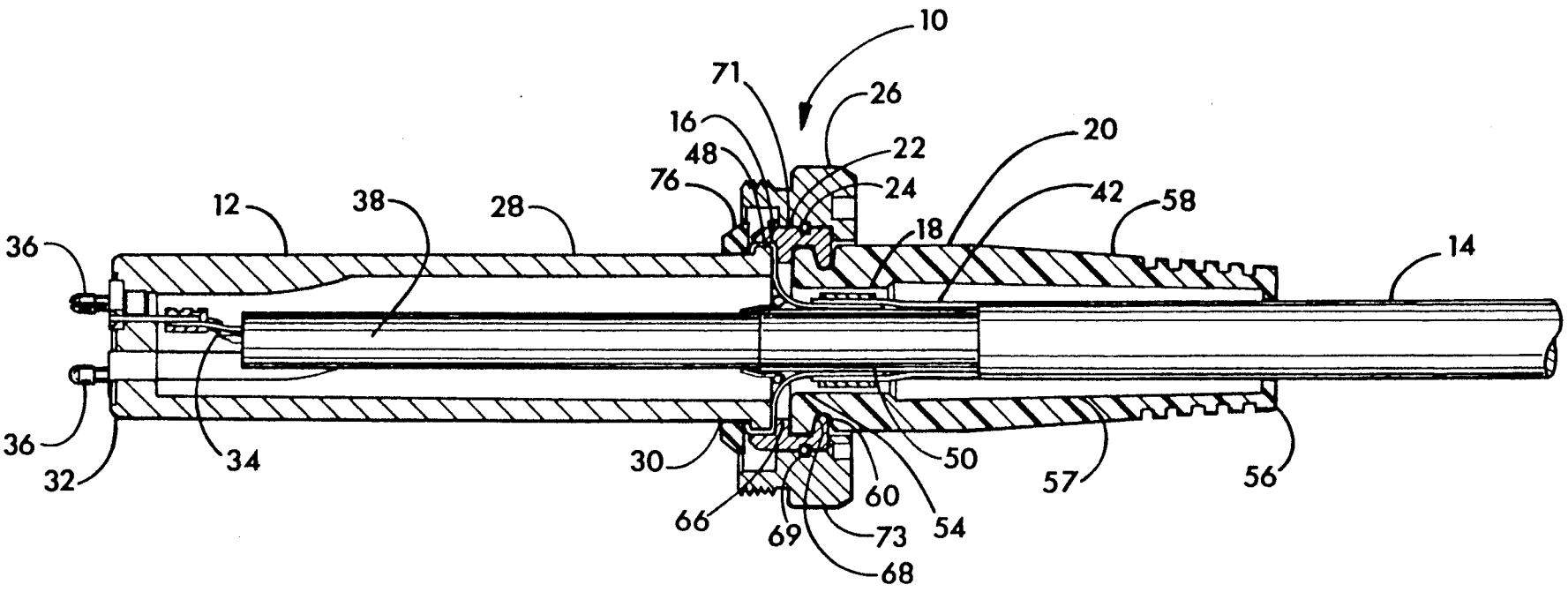
FIG. 3 is a longitudinal cross-section view of the high-voltage x-ray cable connection of the present invention.

With reference to FIGS. 1–3, a high-voltage x-ray cable connection is shown generally at 10. The cable connection 10 comprises a terminal 12, a cable 14, a cap 16, a clamp 18, a flexible boot 20, a collar 22, a ring 24, and a nut 26. The cable connection 10 is generally used to connect with a standard female receptacle and a pattern of sockets (not shown), which form connections for the terminal 12 in a high-voltage power supply, x-ray tube, or similar device requiring high voltage.

The terminal 12 includes a rigid male sleeve 28 having a proximal end 30 and an opposing distal end 32, a plurality of conductors 34 which are routed through the sleeve 28, and a pattern of three pins 36. The conductors 34 extend beyond the distal end 32 of the sleeve 28 and terminate in the pins 36. The three pins 36 typically are connections such as to a large focus filament in the x-ray tube, a small focus filament in the x-ray tube, and to common. The cylindrical shape of the sleeve 28 is sized and the pattern of the pins 36 mate with the female receptacle and the pattern of sockets, respectively, in the high-voltage power supply, x-ray tube, or similar device requiring high voltage.

Figure 4:
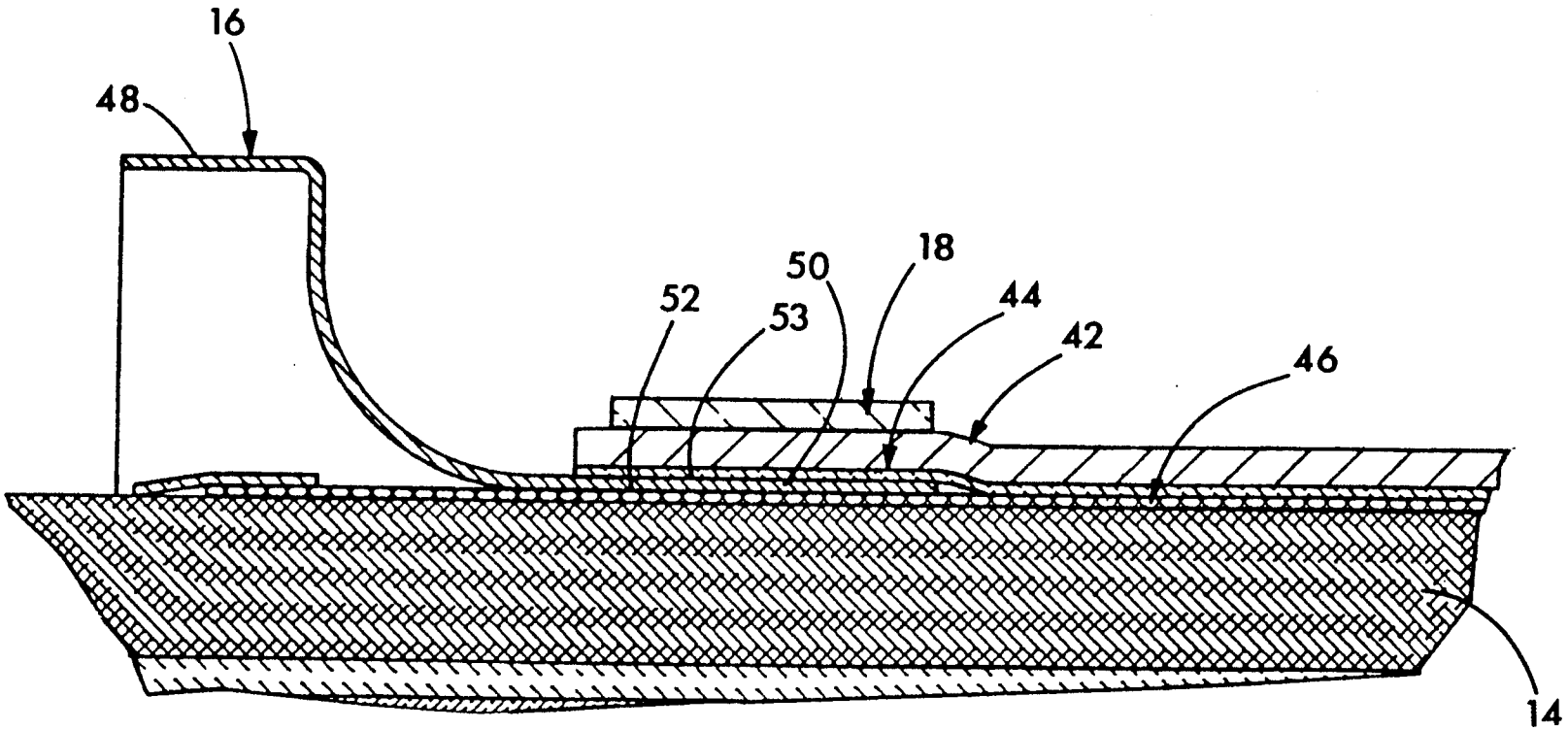
FIG. 4 is an enlarged cross-section detail of the cap and the cable as depicted in FIG. 3, with the boot removed.

The cable 14 has a first end 38, a second end 40 (not shown) and a length defined between the first end 38 and the second end. The cable 14 is made to meet the electrical requirements of the latest publication of NEMA HV X-RAY CABLES AND RECEPTACLES XR 7. Referring specifically to FIG. 4, the cable 14 has a jacket 42 about its circumference which extends across a pre-selected portion of the length, as explained further below. Beneath the jacket 42, a copper braid 44 and a black semiconducting tape 46 are wrapped about the circumference of the cable 14. The conductors 34 continue uninterrupted through the sleeve 28 and the length of the cable 14. The length of the cable 14 is defined by the needs of the customer, specifically the distance between the high-voltage power supply and the x-ray tube.

The cap 16 includes a base portion 48 and a conduit 50. The cap 16 covers, the proximal end 30 of the sleeve 28 and the conduit 50 flares inward from the base portion 48, the conduit 50 having an inside boundary 52 and an outside boundary 53. The first end 38 of the cable 14 is routed through the proximal end 30 of the sleeve 28 through the conduit 46 of the cap 16. The jacket 42 and the copper braid 44 of the cable 14 fit over the outside boundary 52 of the conduit outside boundary 53 of the conduit 46 and the remainder of the cable 14 is routed through the inside boundary 52 of the conduit 50. It should be understood that the jacket 42 and the copper braid 44 extend only so far as to cover the conduit 50 of the cap 16, whereas the remainder of the cable 14 extends further into the sleeve 28.

The clamp 18 is a band which secures the jacket 42 of the cable 14 against the outside boundary 53 of the conduit 50. A suitable material for the clamp 18 is copper which is plated with electroless nickel/low phosphor.

The flexible boot 20 has a first end 54 and a second end 56, the first end 54 in juxtaposed relation with the cap 16 at the proximal end 30 of the sleeve 28. The boot 20 envelops the circumference of the cable 14 at a point where the cable 14 enters the sleeve 28. The boot 20 has an inside boundary 57 and an outside boundary 58, the outside boundary 58 including a groove 60 proximate the first end 54. A suitable material for the boot 20 is a thermoplastic elastomer having a durometer thermoplastic elastomer is SANTOPRENE®, manufactured by the Monsanto Company of St. Louis, Mo., grade number 211-45.

The collar 22 is split into segments 22A and 22B, the segments 22A and 22B collectively forming an inside boundary 62 and outside boundary 64. The inside boundary 62 includes a first circumferential lip 68 and a second circumferential lip 66. The first lip 68 mates with the groove 60 of the boot 20 and the second lip 66 fits between the base portion 48 of the cap 16 and the first end 54 of the boot 20. The afore-described configuration permits the collar 22 to conform about a boundary formed between the proximal end 30 of the sleeve 28 and the boot 20. The segments 22A and 22B each fit about a portion of the boundary formed between the proximal end 30 of the sleeve 28 and the boot 20. For the case illustrated in the drawings, the segments 22A and 22B are each halves which together form the collar 22. The outside diametral boundary 64 of the collar 22 includes a groove 69 which receives the ring 24. Insertion of the ring 24 into the groove 69 holds the segments 22A and 22B together. A suitable material for the collar 22 is ZAMAK 3 casting alloy AG-40A UNS Z33521 plated with electroless nickel.

The nut 26 has an inside diametral boundary 71 and an outside diametral boundary 73. The inside diametral boundary 71 snaps over the outside boundary 64 of the collar 22, though the nut 26 remains free to rotate about the collar 22. The outside diametral boundary 73 includes external threads 75 which mate with internal threads which form a part of the receptacle in the power supply or x-ray tube. The outside diametral boundary 73 further includes a diamond knurled portion 75 which enables a user to readily grasp the nut 26 to permit threading into the female receptacle. The nut 26 may also include spanner holes (not shown) which may be employed to tighten the nut by a spanner wrench. A suitable material for the nut 26 is brass rounds alloy 360 ASTM B16 and plated with chrome.

The cable connection 10 also include an O-ring 76 at the junction of the sleeve 28, the collar 22 and the nut 26.

The high-voltage x-ray cable connection 10 forms a flexible junction between the terminal 12 and the cable 14. The configuration of the connection 10 allows for easy assembly, disassembly, and repair of the connection 10. The cable 14 is attached to the terminal 12 and the cap 16 by the clamp 18, the jacket 42 and the copper braid 44 being positioned about the outside boundary 52 of the conduit 50, and the remainder of the cable 14 extending further into the sleeve 28. The boot 20 is then slid from further down the length of the cable 14 to a position in juxtaposed relation with the proximal end 30 of the sleeve 28. The segments 22A and 22B are placed about the boundary between the proximal end 30 of the sleeve 28 and the boot 20, and the ring 24 is placed in the groove 69 of the collar 22 to hold the segments 22A and 22B together. The nut 26 is slid from further down the length of the cable 14 and snapped into place over the collar 22 and the O-ring 72 is positioned on the sleeve 28 against the collar 22. The connection 10 is then ready for insertion into the female receptacle of the power supply or x-ray tube. The flexible nature connection 10 at the junction between the terminal 12 and the cable 14 permits the user to manipulate the cable 14 without difficulty.

It is to be understood that the connection 10 as just described may be formed at opposing ends on the length of the cable 14. It is to be further understood that the cable connection of the present invention may be applicable to high-voltage applications other than x-ray tubes. It is further to be understood that the invention is not confined to the particular construction and arrangement of parts herein illustrated and described, but embraces such modified forms thereof is come within the scope of the following claims.

What is claimed is:

1. A high-voltage cable connection for connecting a high-voltage power supply and an x-ray tube, the cable connection comprising:

(a) a terminal having a rigid male sleeve formed of insulating material and a plurality of conductors, the sleeve having a proximal end and a distal end, wherein the conductors are routed through the sleeve and extend to the distal end and terminate in a pattern of pins, and wherein the sleeve is shaped to fit within a mating female receptacle and the pattern of pins are arranged to fit within a pattern of sockets which are connectors in the power supply or the x-ray tube;

(b) a cable having a first end, a second end, the conductors extends between the first and second ends, a length defined between the first end and the second end, and a circumference, the first end of the cable being inserted into the proximal end of the sleeve such that the conductors continue uninterrupted through the sleeve and the length of the cable;

(c) a flexible boot which is juxtaposed with the proximal end of the rigid male sleeve and envelops the circumference of the cable at a point where the cable enters the sleeve;

(d) a collar which conforms about a boundary formed between the proximal end of the sleeve and the flexible boot to maintain the boot in position opposed to proximal end of the male sleeve, the collar having multiple segments each of which fit about a portion of the boundary;

(e) a ring which fits about the collar to hold the segments together; and (f) a nut having an external thread portion, the nut fitting over the collar and the ring, and the external threads mating with internal threads which form part of the receptacle in the power supply or the x-ray tube.

2. The high-voltage cable connection of claim 1 wherein the cable connection includes a first terminal, a first boot, a first collar, a first ring, and a first nut which are located at the first end of the cable and a second terminal, a second boot, a second collar, a second ring, and a second nut which are located at the second end of the cable.

3. The high-voltage cable connection of claim 1 further including a cap and a clamp, the cap having a base portion which covers the proximal end of the sleeve and a conduit which flares inward from the base and the conduit having an inside boundary and outside boundary, and wherein the cable includes a jacket and copper braiding about the circumference of the cable, and further wherein the jacket and the copper braiding fits over the outside boundary of the conduit and the remainder of the cable is routed through the inside boundary of the conduit, the clamp securing the jacket and the copper braiding against the outside boundary of the conduit.

4. The high-voltage cable connection of claim 1 wherein the boot has a groove and the collar has a mating lip to permit the collar to conform about the boundary formed between the proximal end of the sleeve and the flexible boot.

5. The high-voltage cable connection of claim 3 wherein the boot has a groove and the collar has a first lip which mates with the groove in the boot and a second lip which fits between the base portion of the cap and the boot to permit the collar to conform about the boundary formed between the proximal end of the sleeve and the flexible boot.

6. The high-voltage cable connection of claim 1 wherein the collar has an outside boundary and the nut has an inside diametral boundary, and the inside diametral boundary of the nut snaps into position about the outside boundary of the collar, and further wherein the nut is freely rotatable about the collar when mating the external threads of the nut with the internal threads which form part of the receptacle in the power supply or the x-ray tube.

7. The high-voltage cable connection of claim 1 wherein the boot is made of a thermoplastic elastomer.

8. The high-voltage cable connection of claim 7 wherein the thermoplastic elastomer has a durometer rating of 45.

9. The high-voltage cable connection of claim 7 wherein the thermoplastic elastomer is SANTOPRENE®.

10. A high-voltage cable connection for connecting a high-voltage power supply and an x-ray tube, the cable connection comprising:

(a) a terminal having a rigid male sleeve formed of insulating material and a plurality of conductors, the sleeve having a proximal end and a distal end, wherein the conductors are routed through the sleeve and extend to the distal end and terminate in a pattern of pins, and wherein the sleeve is shaped to fit within a mating female receptacle and the pattern of pins are arranged to fit within a pattern of sockets which are connectors in the power supply or the x-ray tube; length defined between the first end and the second end, the conductors extending between the first and second ends a circumference, and a jacket and copper braiding about the circumference of the cable, the first end of the cable being routed through the proximal end of the sleeve such that the conductors continue uninterrupted through the sleeve and the length of the cable;

(c) a cap having a base portion which covers the proximal end of the sleeve and a conduit which flares inward from the base, the conduit having an inside boundary and outside boundary, wherein the jacket and the copper braiding of the cable fits over of the outside boundary of the conduit and the remainder of the cable is routed through the inside boundary of the conduit;

(d) a clamp which secures the jacket and the copper braiding of the cable against the outside boundary of the conduit;

(e) a flexible boot which is juxtaposed with the proximal end of the rigid male sleeve and envelops the circumference of the cable at a point where the cable enters the sleeve;

(f) a collar which conforms about a boundary formed between the proximal end of the sleeve and the flexible boot to maintain the boot in position opposed to the proximal end of the male sleeve, the collar having multiple segments each of which fit about a portion of the boundary;

(g) a ring which fits about the collar to hold the segments together; and (h) a nut having an external thread portion, the nut fitting over the collar and the ring, and the external threads meeting with internal threads which form part of the receptacle in the power supply or the x-ray tube.

11. The high-voltage cable connection of claim 10 wherein the cable connection includes a first terminal, a first cap, a first clamp, a first boot, a first collar, a first ring, and a first nut which are located at the first end of the cable and a second terminal, a second cap, a second clamp, a second boot, a second collar, a second ring and a second nut which are located at the second end of the cable.

12. The high-voltage cable connection of claim 10 wherein the boot has a groove and the collar has a mating lip to permit the collar to conform about the boundary formed between the proximal end of the sleeve and the flexible boot.

13. The high-voltage cable connection of claim 12 wherein the boot has a groove and the collar has a first lip which mates with the groove in the boot and a second lip which fits between the base portion of the cap and the boot to permit the collar to conform about the boundary formed between the proximal end of the sleeve and the flexible boot.

14. The high-voltage cable connection of claim 10 wherein the collar has an outside boundary and the nut has an inside diametral boundary, and the inside diametral boundary of the nut snaps into position about the outside boundary of the collar, and further wherein the nut is freely rotatable about the collar when mating the external threads of the nut with the internal threads which form part of the receptacle in the power supply or the x-ray tube.

15. The high-voltage cable connection of claim 10 wherein the boot is made of a thermoplastic elastomer.

16. The high-voltage cable connection of claim 15 the thermoplastic elastomer has a durometer rating of 45.

17. The high-voltage cable connection of claim 15 the thermoplastic elastomer is SANTOPRENE®.

* * * * *

UNITED STATES PATENT AND TRADEMARK OFFICE

CERTIFICATE OF CORRECTION

PATENT NO. : 5,310,361
DATED : May 10, 1994
INVENTOR(S) : Muchowicz et al.

It is certified that error appears in the above-indentified patent and that said Letters Patent is hereby corrected as shown below:

Col. 4, line 52 delete the word -- extends -- and insert -- extending --;

Col. 4, line 66 after the word "to" insert the word -- the --;

Col. 5, line 66, after the word "tube;" at the beginning of the paragraph, insert --(b) a cable having a first end, a second end,--.

Signed and Sealed this

Fourth Day of October, 1994

Bruce Lehman

*Attest:*

BRUCE LEHMAN

*Attesting Officer*

*Commissioner of Patents and Trademarks*